United States Patent [19]

Sauter

[11] Patent Number: 4,951,813

[45] Date of Patent: Aug. 28, 1990

[54] BOX OF SHEET MATERIAL FOR PACKING ARTICLES

[75] Inventor: Josephus C. H. M. Sauter, Eindhoven, Netherlands

[73] Assignee: U.S. Philips Corporation, New York, N.Y.

[21] Appl. No.: 427,280

[22] Filed: Oct. 26, 1989

[30] Foreign Application Priority Data

Nov. 8, 1988 [NL] Netherlands ..... 8802731

[51] Int. Cl.[5] ..... B65D 5/50

[52] U.S. Cl. ..... 206/45.19; 206/420; 206/486; 229/178

[58] Field of Search ..... 206/419, 420, 45.19, 206/45.14, 485, 486; 229/178, 186

[56] References Cited

U.S. PATENT DOCUMENTS

| | | | |
|---|---|---|---|
| 1,370,525 | 3/1921 | Eisenkraft | 206/45.19 |
| 1,561,622 | 11/1925 | Wagner | 206/45.19 |
| 2,086,300 | 7/1937 | Moffa | 206/419 X |
| 2,620,962 | 12/1952 | Powell | 206/485 |
| 2,951,583 | 9/1960 | Sandford | 206/419 X |
| 3,252,566 | 5/1966 | Hanson | 206/45.19 |
| 3,258,191 | 6/1966 | Mueller et al. | 229/178 |
| 3,275,215 | 9/1966 | Paige | 229/178 X |
| 3,746,156 | 7/1973 | Austin, Jr. et al. | 206/45.19 X |

*Primary Examiner*—Paul T. Sewell
*Assistant Examiner*—Jacob K. Ackun, Jr.
*Attorney, Agent, or Firm*—Brian J. Wieghaus

[57] ABSTRACT

The box according to the invention has a panel (12) provided with folding lines (15, 16). The panel (12) is joined along a line (17) to a base portion (1) of the box and along another line (18) to an upright wall (2) of the box. In the collapsed state, the panel (12) bears on the base portion (1) and the upright wall (2) and the box is flat. In the put up state, the panel (12) extends for the major part at a certain distance from the base portion (1) and said wall (2) in order to form a buffer.

5 Claims, 2 Drawing Sheets

BOX OF SHEET MATERIAL FOR PACKING ARTICLES

BACKGROUND OF THE INVENTION

The invention relates to a box of sheet material for packing articles. More particularly, the invention relates to a box having: a rectangular base portion; first opposite walls and second opposite walls, which are each joined to the base portion along first folding lines and second folding lines, respectively, a cover portion joined to a first wall along a third folding line parallel to the first folding lines; and fixing means for holding the box in a put up state. The box also has a panel provided with recesses for receiving articles to be packed, which panel has fourth folding lines parallel to the third folding line and is joined to the box along a fifth line and a sixth line parallel to the third folding line, which panel has side edges extending along the two walls. Such a box is known from U.S. Pat. No. 2,951,583-A. In the known box, the panel is secured to the cover portion and is also joined to the first wall arranged opposite to the first wall joined to the cover portion. When the panel is secured to the cover portion, this results in that, when opening the box, the panel changes its position and shape and is lifted so that a packed article is lifted from the box in order to be presented.

A disadvantage of the known box is that the panel bears, in the closed state of the box, for a large part of its surface on the base portion. Although the box is used for packing lamps, the box offers little protection against shocks because the lamps are located on the said part of the panel. This is a disadvantage of the known box.

It is favourable when a box is available which can readily be put up immediately before articles are packed. It is of importance that the collapsed box, from which is started for the putting up operation, is flat so that this collapsed box occupies little volume.

In order to assemble the known box, first the "in-plano", i.e. the sheet material formed into shape and provided with recesses and folding lines must be glued or machined in another manner to secure the panel to the cover portion. A three-dimensional product is then obtained, which cannot be flattened without bending the material and from which the box must still be assembled by causing the walls to rotate about the respective folding lines.

SUMMARY OF THE INVENTION

The invention has amongst others for its object to provide a box of the kind described in the opening paragraph, which can readily be put up from a box in the collapsed state, the collapsed form being flat. The invention further has for its object to provide a box, in which the panel forms a buffer for the packed articles.

According to the invention, this object is achieved in that the panel is joined to the base portion along the fifth line and is joined to a first wall along the sixth line, the distance between the sixth line and the closest nearest fourth folding line of the panel is greater than the distance between the sixth line and the first folding line along said first wall, and the distance between the fifth line and the sixth line, measured along the panel, is substantially equal to the distance between the fifth line and the sixth line, measured along the base portion and said first wall.

Due to the fact that the panel is joined to the base portion and to a first wall, the panel has the same shape both in the opened and in the closed state of the put up box. The articles in the box consequently have the same position in both states of the box. The difference in distance of the sixth line, along which the panel is joined to the first wall, from the folding line in the panel on the one hand and from the folding line between said wall and the base portion on the other hand results in that a first strip of the panel in the put up box has from the sixth line an increasingly greater distance from the first wall and limits with said wall and the base portion a prismatic space. This strip thus forms a buffer between the articles and said wall. Another consequence is that the panel then, in a second strip, moves gradually farther away from the base portion and passes after a fourth folding line into a third strip, which is joined to the base portion along the fifth line. The panel thus forms at the same time a buffer between the packed articles and the base portion.

In spite of these favourable properties, the box in its collapsed state is flat due to the fact that the distance between the fifth line and the sixth line along which the panel is joined to the base portion and to the first wall, respectively, is equal, measured along the panel and along the first wall and the base portion.

In an embodiment, the panel is integral with the other parts of the box, for example, due to the fact that the panel is joined through connection strips to the first wall opposite to that with the third folding line, along which the cover portion is joined to it. The cover in collapsed state can then readily be obtained from the "in-plano". The panel then need not be aligned before it is secured to the base portion and the first wall.

The fixing means for holding the box in the put up state may consist of tongues which are joined to the first walls and extend pairwise along the second walls and are interlocked, as in the box according to the aforementioned U.S. Pat. No. 2,951,583. The means may alternatively consist of adhesive tape, staples, glue.

In a favourable embodiment not requiring auxiliary means to be provided separately, the walls are serially joined together by inwardly folded tongues, which engage pairwise the inner side of a respective second wall. In this embodiment, each second wall has a vane along a folding line parallel to the second folding lines. The vane is folded over inwardly and encloses together with the second wall the respective inwardly folded tongues and is itself held enclosed between the second wall and a side edge of the panel.

The sheet material of the box may be of different nature, for example fine flute corrugated board, duplex or triplex cardboard. Due to the fact that the base portion is integral with the first and the second walls, the box has a rigid construction, which avoids a base portion that may open and articles to fall out of the packing, as may be the case in other boxes.

BRIEF DESCRIPTION OF THE DRAWINGS

Embodiments of the box according to the invention are shown in the drawings. In the drawings.

DESCRIPTION OF THE PREFERRED EMBODIMENTS

Figure 1:
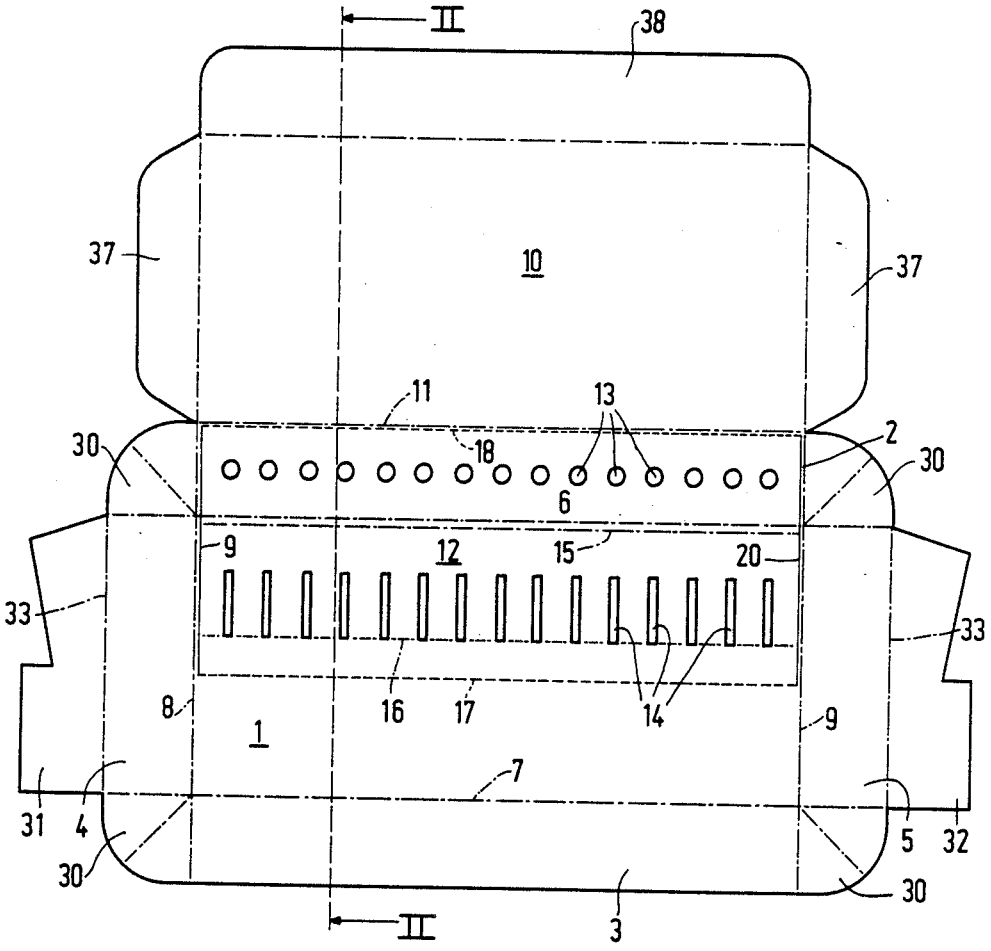
FIG. 1 is a developed view of an embodiment.

In FIG. 1, the box has a rectangular base portion (1), which is limited by the lines 6, 7, 8, 9. First opposite walls 2, 3 and second opposite walls 4, 5 are each joined to the base portion 1 along first folding lines 6, 7 and second folding lines 8, 9, respectively. A cover portion 10 is joined along a third folding line 11 parallel to the first folding lines 6, 7 to a first wall 2, 3, in the Figure to the wall 2.

Fixing means are provided to hold the box in the put up state. In the box is provided a panel 12, which is provided with recesses 13, 14 for receiving articles to be packed. The panel 12 has fourth folding lines 15, 16 parallel to the third folding line 11 and is joined to the box along a fifth line 17 and a sixth line 18 parallel to the third folding line 11. The panel 12 has side edges 19, 20, which extend along the second walls 4, 5.

The panel 12 is joined along the fifth line 17 to the base portion 1 and along the sixth line 18 to the first wall 2.

In an alternative embodiment, however, the panel 12 may be joined to the first wall 3. The distance between the sixth line 18 and the nearest fourth folding line 15 of the panel 12 is greater than the distance between the sixth line 18 and the first folding line 6 along said first wall 2. The distance between the fifth line 17 and the sixth line 18, measured along the panel 12, is substantially equal to the distance between the fifth line 17 and the sixth line 18, measured along the base portion 1 and the first wall 2 (see also FIG. 2).

Figure 3:
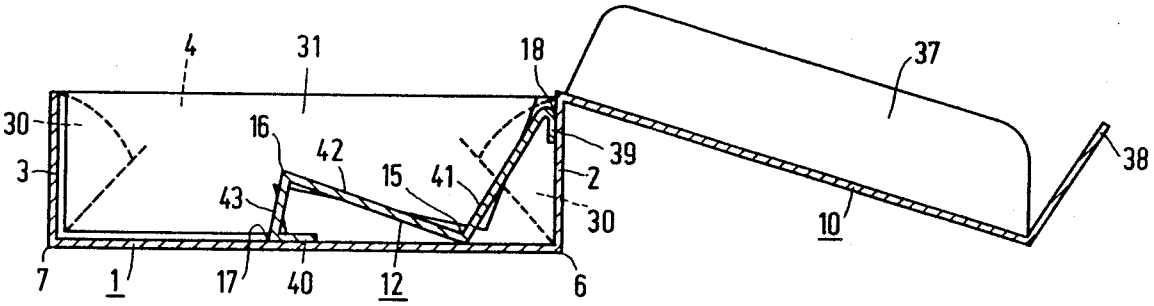
FIG. 3 shows the box of FIG. 2 in the assembled state.

The walls 2, 4, 3, 5 are serially joined together by means of tongues 30, which are folded inwardly in the put up box and then engage the inner side of a respective second wall 4, 5 (see also FIG. 3). Each second wall 4, 5 has a vane 31, 32 along a folding line 33 parallel to the second folding lines 8, 9. The vane 31, 32 is folded over in the assembled box (FIG. 3), and encloses together with the second wall 4 and 5, respectively, the respective inwardly folded tongues 30 and is itself held enclosed between the second wall 4 and 5, respectively, and a side edge 19 and 20, respectively, of the panel 12. As a result, the box is fixed in the assembled state.

Figure 2:
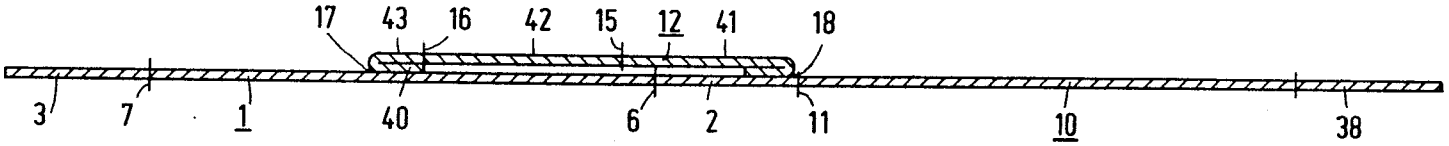
FIG. 2 is a sectional view taken on II—II in FIG. 1.

The panel 12 has a first, a second and a third strip 41, 42 and 43, respectively (FIG. 2). The cover portion 10 has vanes 37 and 38. The vanes 37 become located in the closed state of the box in the embodiment shown between a side edge 19 and 20, respectively, of the panel 12 and a vane 31 and 32, respectively, and thus provide an additional fixation of the box in the put up state. The collapsed box is entirely flat (FIG. 2).

In FIG. 3, two inwardly folded tongues 30 are enclosed between the second wall 2 and the vane 31, which is folded inwards about the folding line 33 (FIG. 1). The vane 31 is itself held enclosed between the second wall 4 and the side edge 19 (FIG. 1) of the panel 12. The box is thus fixed in the put up state.

It appears from FIG. 3 that the panel 12 has the same shape in the opened state of the box as the panel would have in the closed state. The first strip 41 of the panel 12 has from the sixth line 18 an increasingly greater distance from the first wall 2 and limits with this wall 2 and the base portion 1 a prismatic space. The fourth folding line 15 bears on the base portion 1. The panel 12 then moves in a second strip 42 gradually farther away from the base portion 1 and passes after the fourth folding line 16 into a third strip 43, which is joined along the fifth line 17 to the base portion 1. The panel 12 forms for packed articles, for example a Christmas-tree illumination set, a buffer both along the base portion 1 and along the first wall 2.

In another embodiment, the panel 12 can be in contact not only along the fourth folding line 15 with the base portion 1, but also with an additional strip in the panel adjoining said folding line 15. In the embodiment shown, the panel 12 is provided with edge strips 39 and 40 for securing the panel 12 to the first wall 2 and to the base portion 1, respectively.

Figure 4:
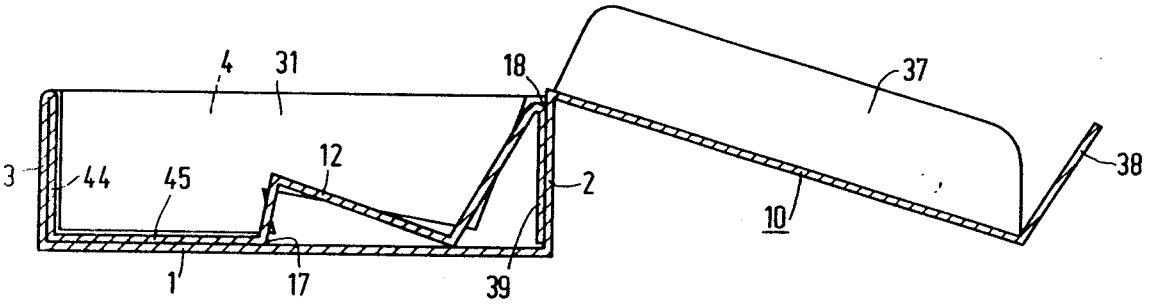
FIG. 4 shows a variation of FIG. 3.

In FIG. 4, parts corresponding to parts in the preceding Figures are provided with the same reference numerals. The panel 12 is now joined through connection strips 44, 45 to the first wall 3 and is integral with the box. In said box, all the walls 2, 3, 4, 5 have double the thickness, just like the base part 1 at the area at which it is not provided with a buffer. The box is thus particularly robust.

The box according to the invention constitutes an omnilateral enclosure for articles packed in it. In the embodiments shown, the box consists of duplex cardboard of 300 g/m$^2$.

I claim:

1. A box of sheet material for packing articles, said box comprising a rectangular base portion, a first pair of opposing walls and second pair of opposing walls, each joined to the base portion along first folding lines and second folding lines, respectively, a cover portion joined to one of said first walls along a third folding line parallel to the first folding lines, and fixing means for holding the box in an assembled state, said fixing means comprising a panel provided with recesses for receiving articles to be packed, said panel having fourth folding lines parallel to the third folding line and side edges extending along the second walls, characterized in that:

said panel is joined to the base portion along a fifth line and to a first wall along a sixth line, the distance between the sixth line and the nearest fourth folding line of the panel is greater than the distance between the sixth line and the first folding line along said first wall, and the distance between the fifth line and the sixth line, measured along the panel, is substantially equal to the distance between the fifth line and the sixth line, measured along the base portion and said first wall.

2. A box as claimed in claim 1, characterized in that the panel is integral with the remaining parts of the box.

3. A box as claimed in claim 2, characterized in that said panel is joined through connection strips to the first wall opposite the other first wall which is adjacent to the third folding line.

4. A box as claimed in claim 1, characterized in that each of said second walls has an inwardly folding vane, the walls of said first and second pair of walls are serially joined together by means of inwardly folded tongues, said tongues being enclosed pairwise between a respective second wall and a respective inwardly folded vane at said wall, and each vane is enclosed between a respective second wall and the side edge of said panel.

5. A box as claimed in claim 2, characterized in that each of said second walls has an inwardly folding vane, the walls of said first and second pairs of walls are serially joined together by means of inwardly folded tongues, said tongues being enclosed pairwise between a respective second wall and a respective inwardly folded vane at said wall, and each vane is enclosed between a respective second wall and the side edge of said panel.

* * * * *